US010196582B1

(12) United States Patent
Black

(10) Patent No.: US 10,196,582 B1
(45) Date of Patent: Feb. 5, 2019

(54) SYSTEM AND METHOD FOR OBTAINING FLUID FROM PLANT PARTS

(71) Applicant: Easy Trim LLC, Broomfield, CO (US)

(72) Inventor: Joseph Black, Broomfield, CO (US)

(73) Assignee: Easy Trim LLC, Broomfield, CO (US)

( * ) Notice: Subject to any disclaimer, the term of this patent is extended or adjusted under 35 U.S.C. 154(b) by 0 days.

(21) Appl. No.: 15/457,848

(22) Filed: Mar. 13, 2017

Related U.S. Application Data

(60) Provisional application No. 62/309,289, filed on Mar. 16, 2016.

(51) Int. Cl.

| | |
|---|---|
| ***B30B 9/04*** | (2006.01) |
| ***C11B 1/08*** | (2006.01) |
| ***B30B 15/06*** | (2006.01) |
| ***B30B 15/34*** | (2006.01) |
| ***B30B 7/04*** | (2006.01) |

(52) U.S. Cl.
CPC ..... *C11B 1/08* (2013.01); *B30B 7/04* (2013.01); *B30B 9/04* (2013.01); *B30B 15/064* (2013.01); *B30B 15/34* (2013.01)

(58) Field of Classification Search
CPC .... B30B 9/04; B30B 9/06; B30B 7/04; B30B 11/02; B30B 15/34; B30B 15/064; B03B 9/00; B03B 13/00; A23N 1/00; A23L 2/04; A23L 3/02; A23L 3/10; A23L 3/12; A23L 3/20; A61K 2236/37; C11B 1/08
USPC ..... 100/316, 319, 324, 325, 326
See application file for complete search history.

(56) References Cited

U.S. PATENT DOCUMENTS 3,871,291 A * 3/1975 Lassiter ..... B03B 9/06 100/320
2016/0296464 A1* 10/2016 Lindsay ..... A61K 9/006

* cited by examiner

*Primary Examiner* — Jimmy T Nguyen
(74) *Attorney, Agent, or Firm* — Perkins Coie LLP

(57) ABSTRACT

A method and system for extracting fluids from plant parts is provided. Plant parts are placed into a filter bag that is placed within a fluid impermeable holder, which is generally a non-stick holder such as wax paper or parchment. The fluid impermeable holder is placed into a press that is operable at an elevated temperature. The press applies pressure at a predetermined temperature for a predetermined time to the fluid impermeable holder and filter bag to compress the plant parts and squeeze or extrude the fluid from the plant parts. After a predetermined time, the press is opened and the fluid impermeable holder is removed. The filter bag, with residual plant parts, is removed from the fluid impermeable holder. The fluid impermeable holder is manipulated to collect the fluids, which manipulation may include freezing the fluids and peeling the fluids from the inner surface of the bag.

5 Claims, 1 Drawing Sheet

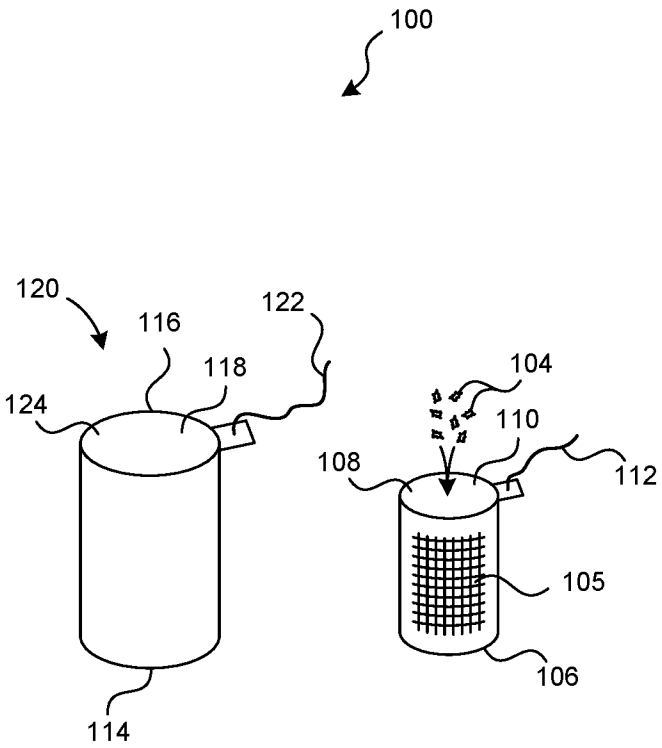
100
104
112
110
105
106
108
122
118
116
120
124
114
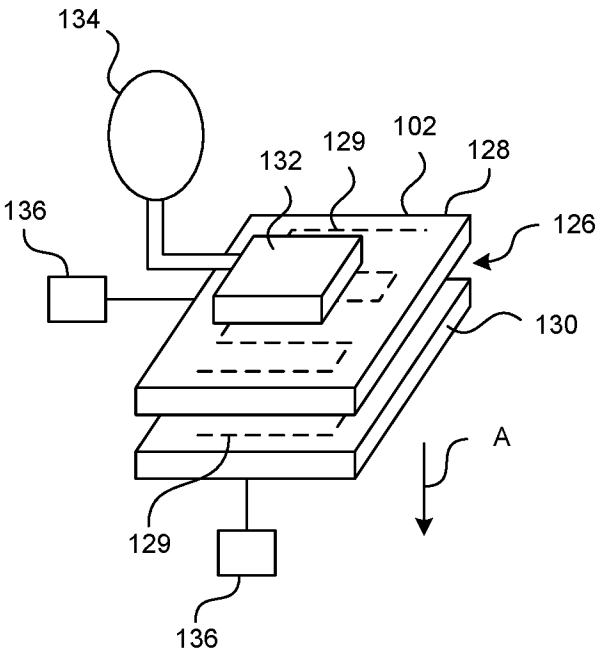
126
128
130
102
129
132
A
134
136
129
136

SYSTEM AND METHOD FOR OBTAINING FLUID FROM PLANT PARTS

CROSS-REFERENCE TO RELATED PATENT APPLICATIONS

The present application claims priority to U.S. Provisional Patent Application Ser. No. 62/309,289, filed Mar. 16, 2016, the disclosure of which is incorporated herein as if set out in full.

BACKGROUND

The fluids contained in plants are often a valuable commodity. For example, hash oil is a valuable fluid extraction taken from parts of a cannabis plant. Conventionally, the extraction of hash oil from cannabis is time consuming and dangerous. Hash oil may be obtained, for example, by using a solvent to extract the oils from the plant parts where the solvent is evaporated from the mixture of oil and solvent after extraction. Exemplary solvents include butane, benzene, methanol, petroleum, to name but a few solvents. Even after evaporation, however, the extracted oil is often contaminated with some residual solvent.

Another type of extraction uses carbon dioxide as the solvent, which is commonly referred to as supercritical carbon dioxide extraction. Using supercritical carbon dioxide to extract the oils includes, among other things, pumping carbon dioxide through the plant matter at a high pressure. Once the desired product is removed, the pressure is released and the carbon dioxide evaporates. While natural, some level of residual carbon dioxide typically remains behind, which contaminates the oil product.

Thus, against this background, it would be desirable to provide a system and method of extracting oils or fluids from plant parts, and more particularly, oils from cannabis plant parts.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, the plant parts are obtained and placed into a filter bag. The filter bag is placed within a fluid impermeable holder, which is generally a non-stick holder such as wax paper or parchment. The filter bag, with plant parts contained therein, and fluid impermeable holder are placed into a press that is operable at an elevated temperature. The press applies pressure at a predetermined temperature for a predetermined time to the fluid impermeable holder and filter bag to compress the plant parts and squeeze the fluid from the plant parts. After a predetermined time, the press is opened and the fluid impermeable holder is removed from the pressure chamber, which chamber may be the space between two opposed plates. The fluid squeezed (or extruded) from the plant exits the filter bag and is contained in the fluid impermeable holder. The filter bag, with residual plant parts, is removed from the fluid impermeable holder. The filter bag may be washed and reused. The fluid impermeable holder is manipulated to collect the fluids, which manipulation may include freezing the fluids and peeling the fluids from the inner surface of the bag.

These and other aspects of the present system and method will be apparent after consideration of the Detailed Description and FIGURES herein.

DRAWINGS

Non-limiting and non-exhaustive embodiments of the present invention, including the preferred embodiment, are described with reference to the following FIGURES, wherein like reference numerals refer to like parts throughout the various views unless otherwise specified.

FIG. 1 is an exemplary illustration of a system and method of extracting fluids from plant parts consistent with the technology of the present application.

DETAILED DESCRIPTION

The technology of the present application will now be described more fully below with reference to the accompanying FIGURES, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to extracting oil from cannabis plant parts. However, the technology described herein may be used to extract fluid or oils from other plant parts, such as, for example, obtaining vegetable oils or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

With reference now to FIG. 1, a system 100 for using a press 102 to obtain oils from plant parts is described. Plant parts 104 are initially obtained or harvested in a conventional manner. The plant parts 104 may come in a variety of states depending on how fine the plant parts are harvested. In other words, the plant parts may be granular parts, leaf parts, hemp parts, or the like. The plant parts 104 are placed into a filter bag 106. The filter bag 106 is generally a cloth or synthetic mesh material having mesh sizes 105 between the ranges of about 1 micron to about 250 microns depending on the granularity and size of the plant parts 104. The larger the plant parts 104, the larger the mesh for the filter bag may be such that the oils and fluids may freely flow from the filter bag, but the residual plant parts remain contained within the filter bag. The filter bag, in other words, works similar to a tea bag in that the tea leaf is contained in the bag, but the hot water is allowed to enter and exit the tea bag after extracting certain essences from the tea leaves for flavor. For fine grain plant parts 104, it has been found that a mesh size of approximately 10 to 85 microns works satisfactory. In certain aspects, mesh sizes of 20, 22, 25, and 87 microns have been used to obtain the oils using the methods and systems described herein. Generally, the filter bag 106 may be formed of any material that can withstand and transmit the temperatures and pressures described further below to the plant parts. In certain embodiments, the filter bag 106 may be optional.

The filter bag 106 generally is a pouch shape where the top edge 108 defines an opening 110 into which the plant parts 104 are placed. The top opening 110 may be closed by any conventional means 112, such as the draw string 112 shown. In certain aspects, the top opening 110 may be closed by hook and loop fasteners, folding the top edge 108 over on itself, a zipper, a plastic lock similar to a freezer bag lock, or the like. Any of the above may be considered a means for closing the filter bag 106. Also, while shown as a bag or pouch shape, the filter bag 106 could simply be filter paper folded to form an enclosed cavity where the plant parts 104 are contained.

The filter bag 106 is next placed into a fluid impermeable holder 114. The fluid impermeable holder 114 has a top edge 116 defining an opening 118 into a cavity 120. The filter bag 106 is placed into the cavity 120 and the opening 118 is closed. Similar to the filter bag 106, the fluid impermeable holder 114 may include any conventional means to close 122, such as the draw string 122 shown. In certain aspects, the opening 118 may be closed by hook and loop fasteners, folding the top edge 116 over on itself, a zipper, a plastic lock similar to a freezer bag lock, or the like. The fluid impermeable holder 114 should have a non-stick inner surface 124. The non-stick inner surface 124 generally means the filter bag 106 (and the residual plant parts) may be easily removable from the fluid impermeable holder and the oils may be removed as well, which will be explained below. The fluid impermeable holder 114 needs to be formed of a material that is capable of withstanding and transmitting the pressures and temperature to be explained below. In certain exemplary embodiment, the fluid impermeable holder 114 is formed from parchment paper or wax paper. Other fluid impermeable holders 114 may include gels and synthetics. In one aspect, the fluid impermeable holder 114 may be formed of a plastic, composite, or rubber where the inner surface 124 comprises a surface coating of wax or the like to facilitate the non-stick nature of the inner surface 124.

The fluid impermeable holder 114, which the filter bag 106 containing plant parts 104, is placed into a cavity 126 of the press 102. The cavity 126 may be the space between two opposed press plates 128, 130 as shown. The press 102 may have a stationary plate 130 and a moveable plate 128. In certain aspects, both plates 128 and 130 are moveable. The press 102 allows the application of a compressive force to the fluid impermeable holder 114 that squeezes the plant parts 104 in the filter bag 106.

As shown, plate 128 is moveable where plate 130 is presently shown as stationary. A pneumatic piston 132 is provided on plate 128 to drive plate 128 towards plate 130 to provide a compressive force A. The compressive force should be sufficient to extract the oils or fluids from the plant parts. Presently, a 12 ton gas drive compressor is used to apply the compressive force A where the pneumatic piston 132 is in fluid communication with an air supply 134 charged to between 40 and 60 pounds per square inch (PSI). The air supply 134 could be a pressurized tank or gas compressor. While shown as a pneumatic press, where the compressive force A is supplied by gas and the return is controlled by tension springs, the press 102 may be driven by an electric motor, a lever, a winch, or the like. Rather than a pneumatic press or drive, the press may operate by a hand crank and gear system or an electronic motor in certain embodiments.

Substantially simultaneously with applying the compressive force, the plant parts 104 should be heated to facilitate extraction of the fluids and oils. Generally, the plant parts 104 should be heated to between about 100 to 450° F. although temperatures above room as low as 80 or 90° F. and greater than 450° F. would also work. In the exemplary embodiment, the plates 128 and 130 are configured to conduct heat to the cavity 126. For example, each plate 128, 130 may be coupled to a temperature controller 136 that supplies electrical power to heater coils 129 (shown in phantom) coupled to the plates 128, 130. While shown as two separate temperature controllers, a single controller may be used in some instances. Generally, the temperature is controlled to a single temperature, but each plate may be provided at different temperatures in certain embodiments. A good yield at the above air pressure is obtained at a temperature of 200° F. or temperatures between about 180 to 210° F. Satisfactory yields are obtained at temperatures between 100° F. and 110° F. as well as between about 225° F. to about 260° F.

The compressive force A is applied to the plant parts 104 at temperature for a period of time to extract the oils and fluids. While the overall time depends on the type of plant part and the volume, for smaller volumes of fine grain plant parts, the compressive force A only needs to be applied for about 1 to 3 minutes. Fluid may be extruded, however, at times as low as several seconds. Thus, the technology works for compressions of 2 seconds or more. To obtain a desired level of fluid, it has been found that compression for time from about 10 seconds to about one minute function well depending on the type and quality of the plant part. While compression may be applied longer, after about 3 minutes most of the fluid has been extruded.

Using the fluid impermeable holder 114 is beneficial as it inhibits fouling of the plates 128, 130 of the press 102. However, in certain aspects, the cavity 126 may be provided with a sump or the like such that the filter bag 106 may be placed directly into the cavity 126 without the fluid impermeable holder 114. When pressure is applied, the oils and fluids that are extracted through the filter bag 106 would be collected in the sump rather than in the fluid impermeable holder 114. In this arrangement, providing plates with non-stick surfaces may be beneficial. Such non-stick surfaces may be comprised of parchment paper, wax paper, polytetrafluoroethylene, other fluoropolymers, or the like. Presses with a sump may be configured with vertical surfaces rather than horizontal surfaces as shown in FIG. 1.

Subsequent to squeezing the fluid impermeable holder 114, the fluid impermeable holder 114 is removed from cavity 126. The filter bag 106, now containing residual plant parts (not specifically shown) is removed from the fluid impermeable holder 114. The residual plant parts may be composted or the like as waste product. The fluid or oils extracted from the plant parts are contained in the fluid impermeable holder 114 which may now be manipulated to gather the fluids or oils extracted. In one exemplary embodiment, the parchment may be placed in a freezer to cool the fluids or oils, which may be relatively viscous materials approaching gels in some cases. The fluids or oils may be peeled from the inner non-stick surface 124 (or the sump) once the fluids or oils are sufficiently viscous or solid. In other aspects, glass tools (or other chemically inert tools) may be used to scrap the fluids or oils from the inner non-stick surface 124 (or the sump).

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. As defined by the context, the terms about or approximately may means within a tolerance of, for example, ±10%. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A system to extract fluids from one or more plant parts comprising:

a first press plate containing a first heating coil;

a second press plate containing a second heating coil operably coupled to the first press plate wherein the first press plate and the second press plate are moveable with respect to each other;

a fluid impermeable holder, wherein the fluid impermeable holder is configured to hold at least one plant part and contain fluids extruded from the at least one plant part when the first press plate and the second press plate are compressed together;

a space between the first press plate and the second press plate that is configured to receive the fluid impermeable holder;

at least one temperature controller, the at least one temperature controller coupled to at least one of the first heating coil and the second heating coil to heat at least one of the first press plate and the second press plate to between approximately 100° F. to 450° F.; and a motive force mechanism coupled to at least one of the first press plate and the second press plate operable to move at least one of the first press plate and the second press plate to compress the space.

2. The system of claim 1 wherein the fluid impermeable holder is formed from at least one of parchment, wax paper, silicone, fluoropolymers, or a combination thereof.

3. The system of claim 1 further comprising a filter bag to hold the at least one plant part and the filter bag is sized to fit within the fluid impermeable holder.

4. The system of claim 1 wherein the motive force mechanism is pneumatic.

5. The system of claim 1 wherein the motive force mechanism is electrical.

* * * * *